United States Patent [19]

Jeng

[11] Patent Number: 4,811,953

[45] Date of Patent: Mar. 14, 1989

[54] NUMBERING GUESSING GAME STRUCTURE

[76] Inventor: Horng-tsair Jeng, 1Fl., No. 12, Alley 81, Lane 222, Huu Lin St., Taipei, Taiwan

[21] Appl. No.: 112,248

[22] Filed: Oct. 23, 1987

[51] Int. Cl.[4] ..... A63F 3/00; A63F 7/00

[52] U.S. Cl. ..... 273/265; 273/120 R

[58] Field of Search ..... 273/120 R, 138 R, 265; 434/189

[56] References Cited

U.S. PATENT DOCUMENTS

| | | | |
|---|---|---|---|
| 2,899,206 | 8/1959 | Carter | 273/138 R |
| 3,048,402 | 8/1962 | Schaper | 273/120 R X |
| 3,501,151 | 3/1970 | Ketchum | 273/265 |
| 3,851,879 | 12/1974 | Hicks | 273/120 R |
| 4,006,344 | 2/1977 | Schutte | 434/189 X |
| 4,474,558 | 10/1984 | Quercetti | 434/189 |

FOREIGN PATENT DOCUMENTS

| | | | |
|---|---|---|---|
| 215238 | 11/1984 | German Democratic Rep. | 273/138 R |
| 2026873 | 2/1980 | United Kingdom | 273/120 R |

*Primary Examiner*—Anton O. Oechsle

*Attorney, Agent, or Firm*—Asian Pacific Int'l Patent and Trademark Office

[57] ABSTRACT

This invention relates to a novel structure of a ball type "figure-guessing" game, and in particularly refers to the structure of game which is composed of several cases, a base and a top plate. All cases have identical outer appearances to the naked eye, making it difficult to distinguish their differences; each case differs from the other cases only in internal structure. By random arrangement of cases by the player, a solution number is generated. The player can input his guess by placing balls in a top plate; the balls take different paths in the cases, to ultimately provide hints that enable the player to revise his guess, until his guess matches the solution of riddle.

2 Claims, 7 Drawing Sheets

NUMBERING GUESSING GAME STRUCTURE

BACKGROUND OF THE INVENTION

One currently prevailing figure-guessing game is played by two persons, each of them providing the other person a "set of figure" riddle whose answer is kept by the provider. The other person will guess a figure, and his guess will be compared with the solution figure to see how many digits in the figure correspond with the digits in the solution figure. Then a hint is provided, enabling the other person to revise, time by time, his figures. The winner will be the one who gives the correct answer in a minimum time. Through this game, the player's thoughts can be trained. Moreover players can compete their intelligence with each other. Hence, this game is useful. However, this game has some demerits. Firstly, this game requires the participation of two players; in other words, an individual cannot play alone to enhance his intelligence. Secondly, it often happens that an incorrect hint is provided (due to careless mistakes); an incorrect hint will affect the proceeding of the game or even terminate it.

SUMMARY OF THE INVENTION

This invention relates to a figure-guessing game that includes a "set of figure" solution generated by random arrangement. A hint is generated from the input of players figures into the game, which enables the player to revise based on hints provided, so that finally he can correctly give the answer.

The main object of this invention is to provide a figure-guessing game that can be played by one or more individuals. This game is designed to not only avoid the drawbacks of the original figure-guessing game but to also substantially retain the "intelligence" factor in the game.

Another object of this invention is to provide a game wherein hints are obtained by playing the game, not from the other player, whereby player mistakes are not a factor in the game outcome.

DETAILED DESCRIPTION OF THE DRAWINGS (PREFERRED EMBODIMENT OF THE INVENTION)

Figure 1:
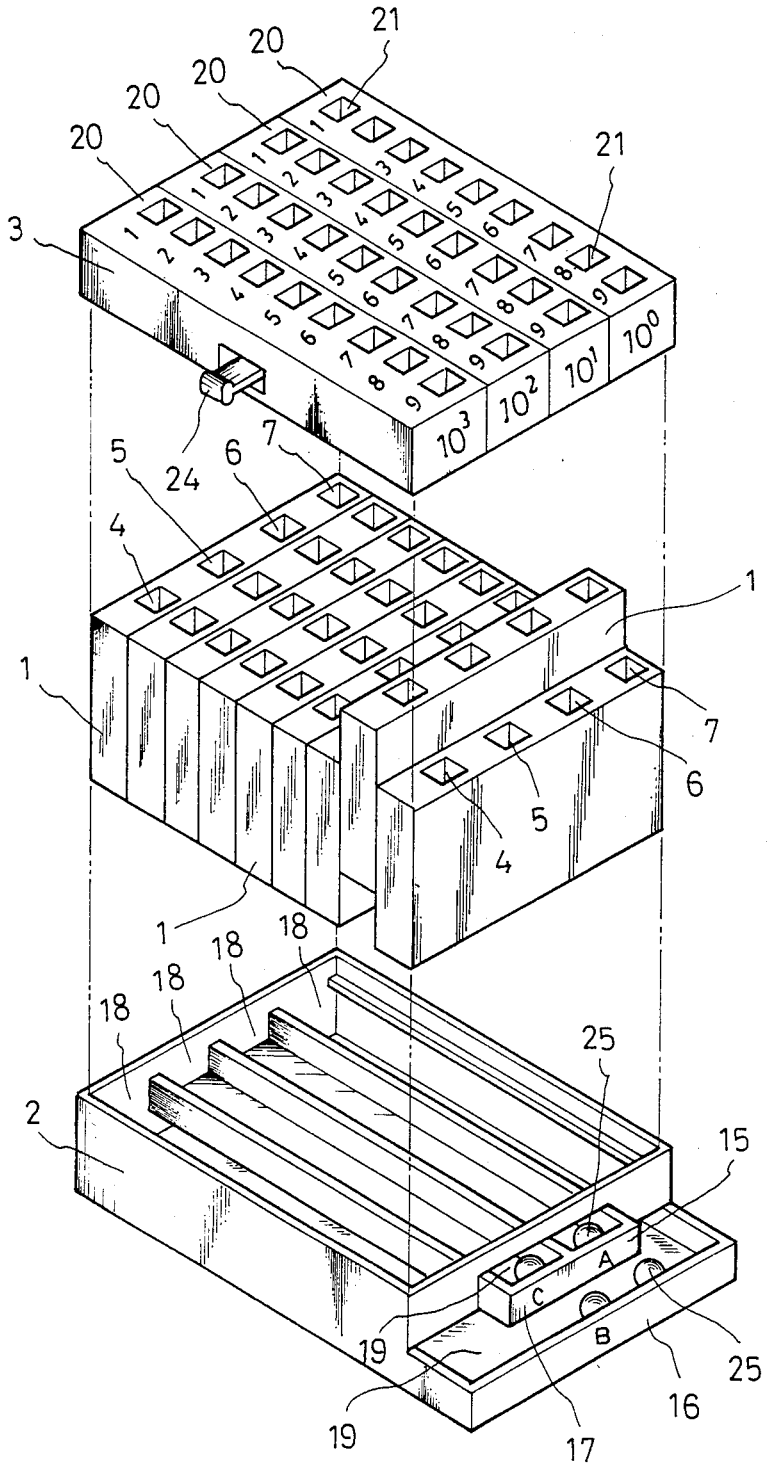
FIG. 1 is an exploded view of this invention.

A preferred embodiment of this invention is shown in detail in the drawings.

Referring to FIG. 1, an embodiment of this invention is mainly composed of nine cases (or chute structures) 1, a base 2 and a top plate 3. In the top plate 3, there are four rows of openings; such row is designated by numeral 20. There are nine holes 21 in each row of openings 20. Each row of openings and each hole are labeled respectively with number "$10^3$", "$10^2$", "$10^1$" and "$10^0$", and from number one to nine. These symbols are used to represent different numbers. For example, "3592" can be represented by the 3rd hole in the row of $10^3$, the 5th hole in the row of $10^2$, the 9th hole in the row of $10^1$, and the 2nd hole in the row of $10^0$.

Figure 2A:
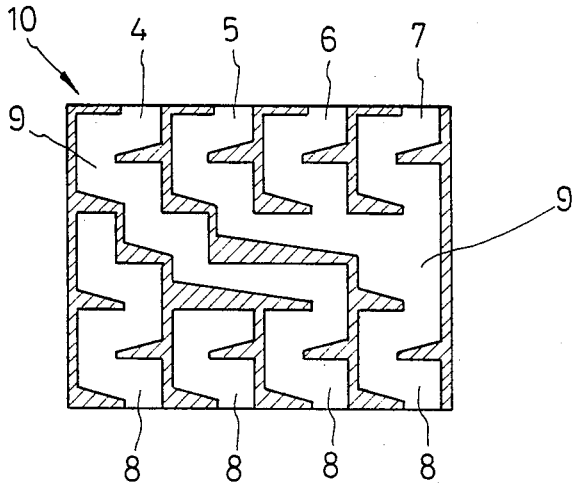
FIG. 2A is the sectional view of a 1st type case structure used in the FIG. 1 embodiment of this invention.
Figure 2B:
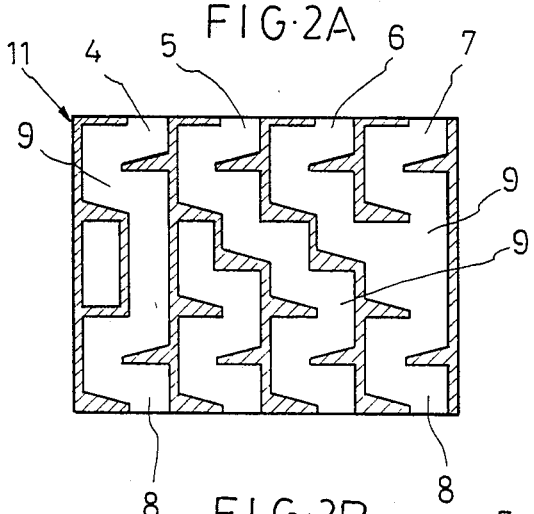
FIG. 2B is the sectional view of a 2nd type case structure used in the FIG. 1 embodiment of this invention.
Figure 2C:
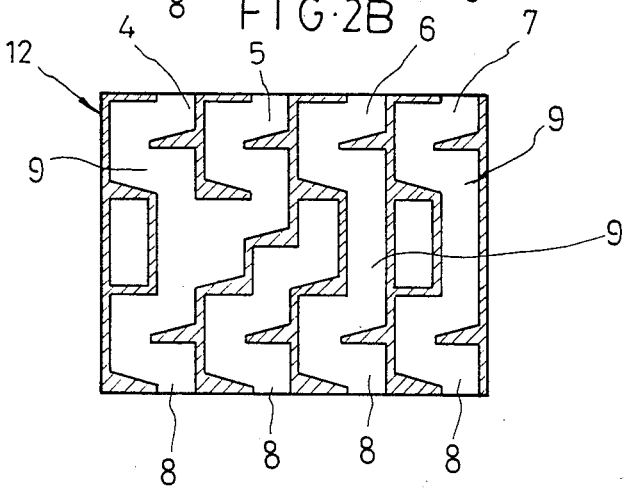
FIG. 2C is the sectional view of a 3rd type case structure used in the FIG. 1 embodiment of this invention.
Figure 2D:
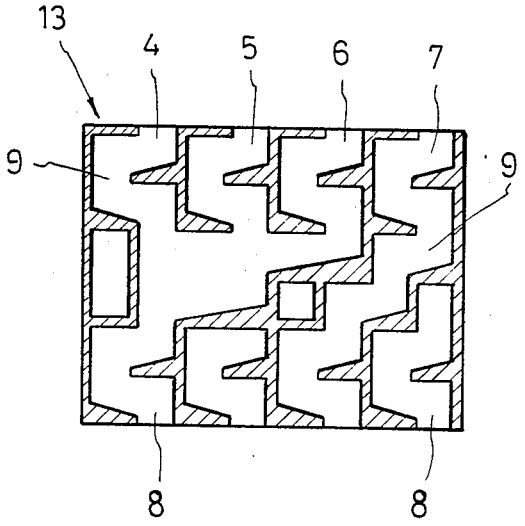
FIG. 2D is the sectional view of a 4th type case structure used in the FIG. 1 embodiment of this invention.
Figure 2E:
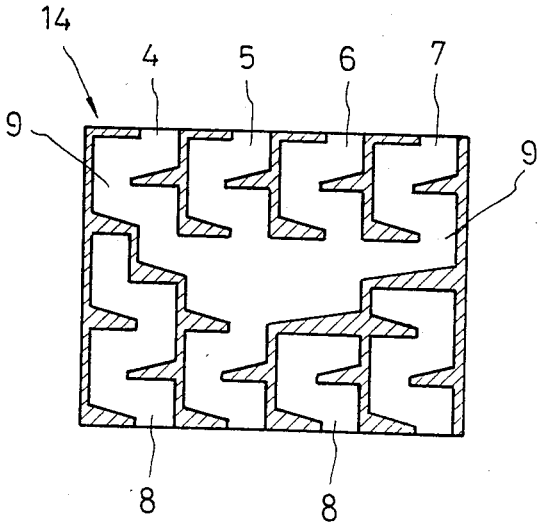
FIG. 2E is the sectional view of a 0 type case structure used in the FIG. 1 embodiment of this invention.

Referring to FIGS. 2A, 2B, 2C, 2D, and 2E, there are four entrance openings 4, 5, 6 and 7 and four exit openings B; entrance openings 4, 5, 6 and 7 are connected to exit openings B by means of paths 9 inside the associated case 1. The nine cases 1 (FIG. 1) have identical outer appearances, and by naked eye, it is difficult to distinguish their differences. They differ only in the structure of paths 9. All together, there are five different types of case constructions namely, the 1st type 10, (FIG. 2A), 2nd type 11, (FIG. 2B), 3rd type 12, (FIG. 2C), 4th type 13 (FIG. 2D) and 0 type 14 (FIG. 2E). There is only one case using each type of case construction, except the 0 type where there are five cases using the 0 type case construction. The four different case constructions (FIGS. 2A–2D) plus the five duplicate case constructions (FIG. 2E) make up the complement of nine cases shown in FIG. 1.

Figure 3:
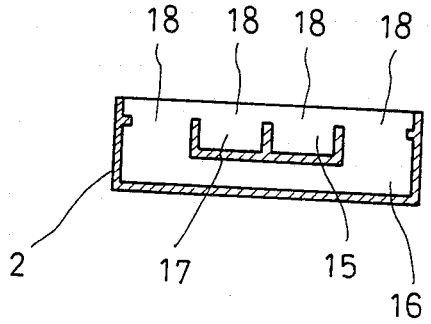
FIG. 3 is a sectional view through a base structure used in the FIG. 1 embodiment of this invention.

Referring to the base 2 in FIG. 3, it has three different and isolated regions 15, 16 and 17. In FIG. 1 these regions are respectively labeled with the letters A, B and C for distinction. In base 2, there are four channels 18 which connect respectively to the three different regions 15, 16 and 17, such that a steel bead [ball] is guided by each channel into region A, B or C. Referring to FIG. 1, the exposed ends of the channels form square pockets that are used for observation and picking up of steel beads in the three regions 15, 16, 17 of base 2.

Figure 4:
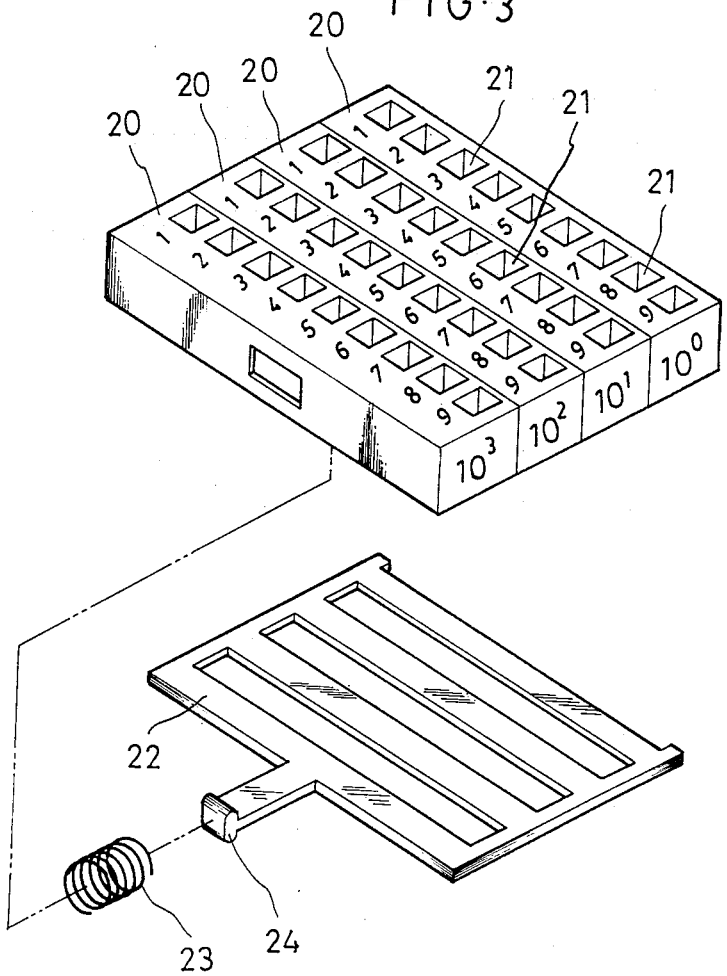
FIG. 4 is an exploded view of a top plate structure used in the FIG. 1 embodiment of this invention.
Figure 5:
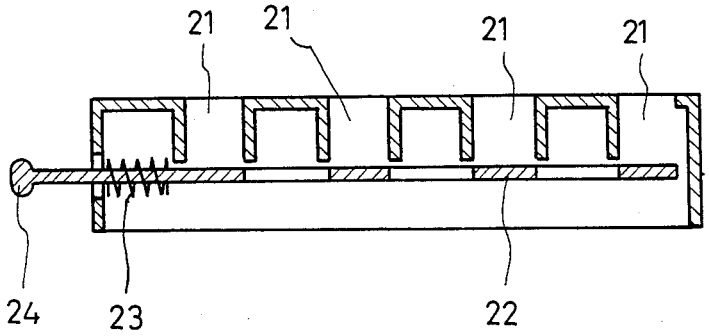
FIG. 5 is a sectional view taken through the top plate structure shown in FIGS. 1 and 4.

In FIG. 4 and FIG. 5, there is a movable plate (or gate) 22 installed just under the holes 21 of top plate 3; the plate can be moved left or right in order to control the opening or closure of holes 21. Installed on one side of movable plate 22 is a spring 23. By the action of spring 23 on movable plate 22, holes 21 are normally in closure. A handle 24 can be pulled manually to move plate 22 so that all holes 21 of the four rows of openings 20 open. The "open" position of handle 24 is shown in dashed lines in FIG. 7.

Figure 6C:
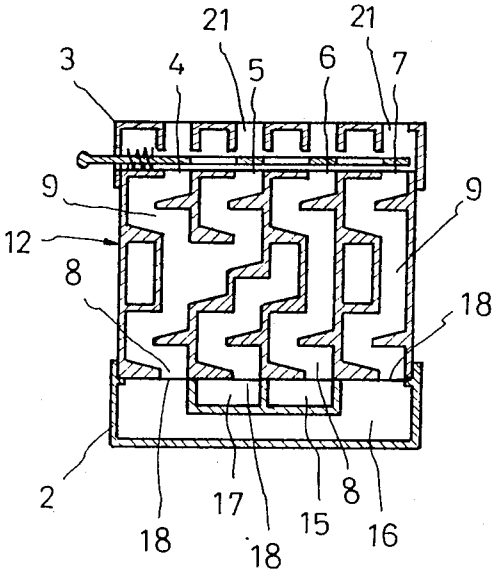
FIG. 6C is a sectional view of the assembled structure of 3rd type case, base and top plate used in the FIG. 1 embodiment of this invention.
Figure 6B:
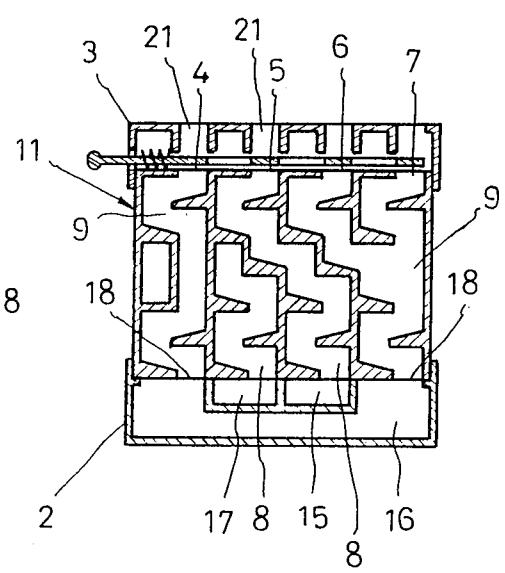
FIG. 6B is a sectional view of the assembled structure of 2nd type case, base and top plate used in the FIG. 1 embodiment of this invention.
Figure 6A:
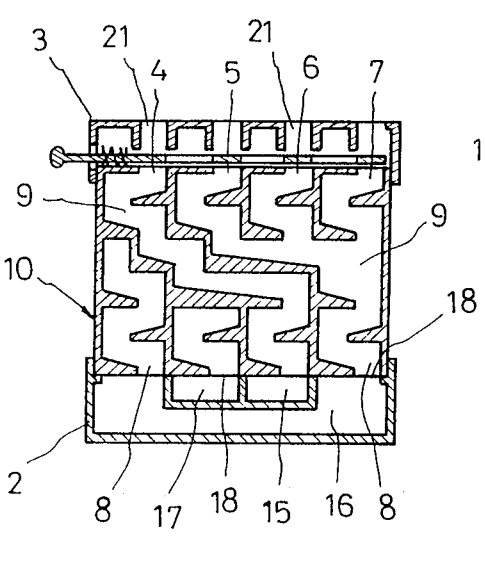
FIG. 6A is a sectional view of the assembled structure of the 1st type case, base and top plate used in the FIG. 1 embodiment of this invention.
Figure 6E:
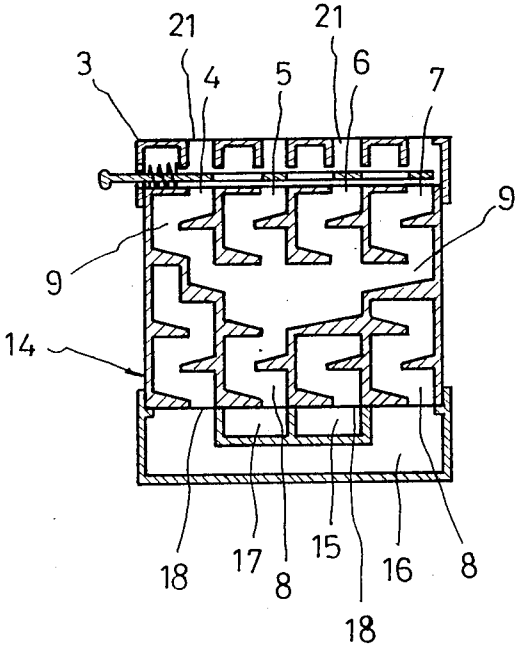
FIG. 6D is a sectional view of the assembled structure of 4th type case, base and top plate used in the FIG. 1 embodiment of this invention.
Figure 6D:
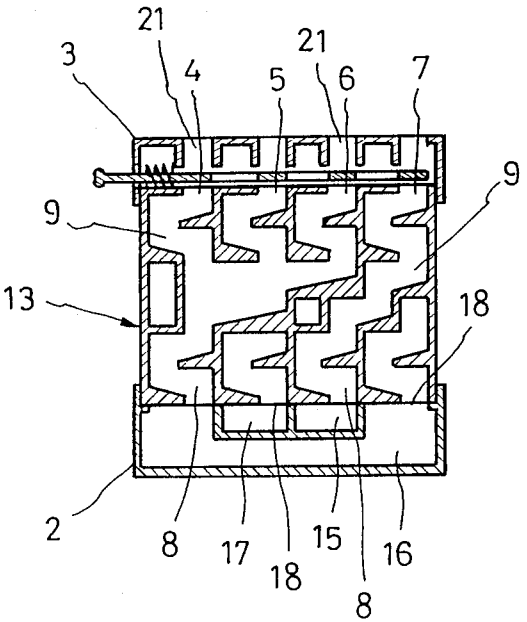

Referring to FIGS. 6A, 6B, 6C, 6D, and 6E, the four exit openings 8 of each case 1 structure are shown connected respectively to the four channels 18 of base 2, i.e. by manual placement of cases 1 on base 2. The top plate 3 is placed on (over) cases 1 so that the four entrance openings 4, 5, 6, 7 of each case 1 are respectively connected to the holes 21 of four rows of openings 20; entrance openings 4, 5, 6, 7 are in potential direct connection to the three regions 15, 16, 17 in base 2, but the connection paths are different for different cases 1. The first entrance 4 of 1st type 10 is connected to region A 15, whereas the other entrances 5, 6 7 are in connection with region B 16 as shown in FIG. 6A; the second entrance 5 of 2nd type case 11 is connected to region A 15, whereas the other entrances 4, 6, 7 are in connection with region B 16 as shown in FIG. 6B; the third entrance 6 of 3rd type case 12 is connected to region A 15, whereas the other entrances 4, 5, 7 are in connection with region B 16 as illustrated on FIG. 6C; similarly, the fourth entrance 7 of the 4th type case 13 is connected to region A 15, and the other entrances 4, 5, 6 are in connection with region B 16 as illustrated in FIG. 6D. All holes 4, 5, 6, 7 of 0 type case 14 are connected to region C 17, as shown in FIG. 6E.

The following chart shows the relationship between the various entrance openings (4,5,6,7) and the target pocket regions A, B and C, for the various different case constructions (FIG. 6A through FIG. 6E):

| Case Structure | Entrance Opening 4 | 5 | 6 | 7 |
|---|---|---|---|---|
| 6A | A | B | B | B |
| 6B | B | A | B | B |
| 6C | B | B | A | B |
| 6D | B | B | B | A |
| 6E | C | C | C | C |

Target position (pocket) A represents the true (unique) digit which the player is attempting to guess. The object of the game is to guess a four digit number represented by the locations of the chute paths leading to target pocket A; there are only four chute paths leading to pocket A. The other chute paths lead to pockets B or C, as indicated by the above chart.

Figure 7:
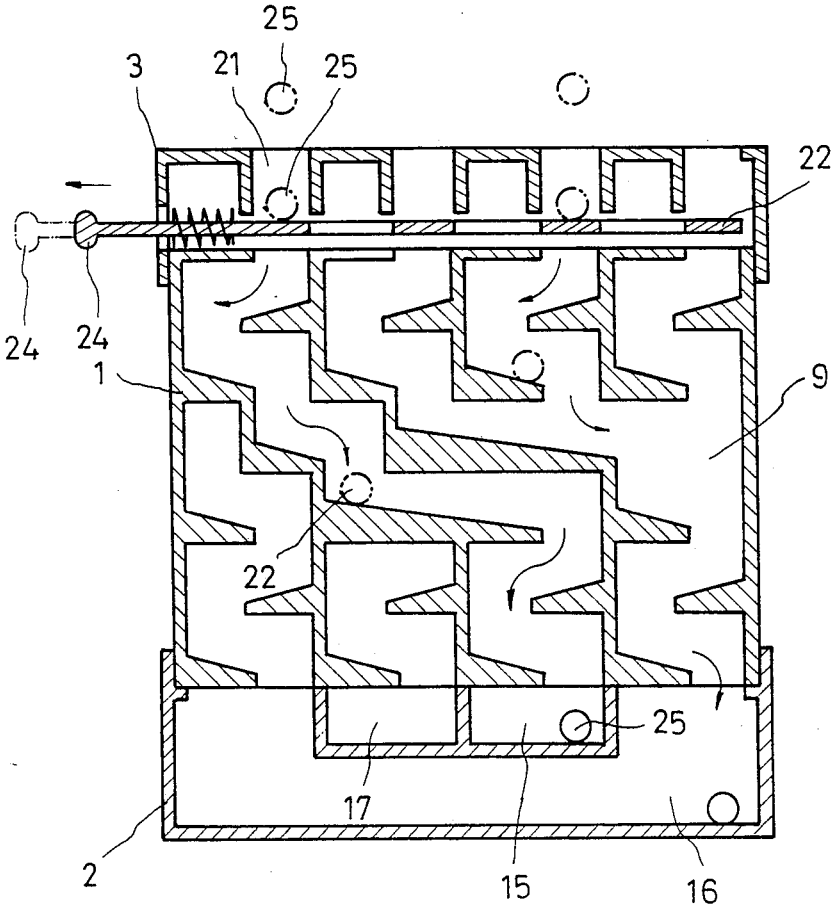
FIG. 7 is a semi-schematic illustration of the operational process of the FIG. 1 embodiment of this invention.

FIG. 7 schematically illustrates the operational process of the FIG. 1 embodiment of this invention. Firstly, four steel beads 25 are placed on the holes 21 of the player's desired numbers in top plate 3. By pulling handle 24 to the left, plate 22 will shift to the left, permitting the four steel balls (beads) 25 to fall through the different paths in cases 1 into the three regions 15, 16, 17.

When playing the game the player first randomly arranges the nine cases, and then puts them on base 2. Top plate is then laid on cases 1. An unknown riddle (four-digit number) is thus generated.

Player can input his guess as to the unknown four digit number by placing four steel beads in selected holes 21 in the four rows of openings 20 in top plate 3. Referring to FIG. 7, by pulling handle 24, movable plate (gate) 22 shifts and holes 21 open. The four steel beads simultaneously enter cases 1, and fall along paths 9 in the cases into the three regions 15, 16, 17 in base 2. Referring to FIG. 1, from the exposed square pockets 19, the player can observe the number of steel beads 25 in the three different regions 15, 16, 17 in base 2; the locations of the beads give the player a hint as to the true four digit number.

The number of steel beads deposited in region A represents how many guessed digits are identical with actual digits in the solution number at the same position, whereas, the number of steel beads in region B represent how many guessed digits are identical with actual digits in the solution number but at a wrong position, the number of steel beads in region C represents how many of the guessed digits are incorrect. For example, supposed that the solution of the riddle is "3758" and player's guess is "3592". The figure "3" guess is identical with the figure "3" of the solution and at the same $10^3$ position; the figure "5" guess is identical with the figure "5" of the solution but at a different position (row), whereas the other two figures "9", and "2" are completely different from figures "3", "7", "5" and "B" of the solution. Therefore, after the player has inputed the guess "3592" a hint will be generated by the fact that one steel bead is in region A, one is in region B and two are in region C.

The player can then pick up steel beads 25 from exposed square pockets 19 of base 2 and repeat the above procedure. From hints and correlations, figures guessed are revised again and again until the four digit guess matches the answer; in other words, there are four steel beads in region A.

At the start of the game the player is given information as to the nature of the various pockets A, B and C. He knows that any ball deposited in pocket A is correct as to digit selection and placement in a row, and that any ball deposited in pocket B is correct as to digit selection but incorrect as to placement in a row, and that any ball deposited in pocket C is an incorrect selection.

During the course of the game the player records his ball placements and results associated with each ball selection (each actuation of gate 22); this provides hints (information) that enables him to eventually reach a solution to the riddle. Following is how a representative game might be played.

The player arranges the various nine case structures on base 2 so that the balls will fall into the various pockets A, B or C, according to the following relationship:

| Case Position | 1st row $10^3$ | 2nd row $10^2$ | 3rd row $10^1$ | 4th row $10^0$ |
|---|---|---|---|---|
| 1 | C | C | C | C |
| 2 | A | B | B | B |
| 3 | B | B | A | B |
| 4 | C | C | C | C |
| 5 | C | C | C | C |
| 6 | B | A | B | B |
| 7 | C | C | C | C |
| 8 | B | B | B | A |
| 9 | C | C | C | C |

The four digit solution is "2638" (where the "A" positions are in the various rows). Initially the player is unaware of where the chutes leading to the "A" positions are located; all case structures 1 have the same external appearance.

Suppose the players first guess is "6847", i.e. he places the first ball (1st row) in case #6, the second ball in case #8, the third ball in case #4, and the fourth ball in case #7. The results will be as follows:

2 balls in pocket B 2 balls in pocket C

He learns the following information: The correct number includes two of the four selected digits, but not the other two digits. The two "correct" digits are not in the originally selected rows.

Suppose the second guess is "1968", i.e. the player arbitrarily discards the 4 and 7, while shifting the 6 and 8 to the third and fourth rows. The results will be as follows:

1 ball in pocket A
1 ball in pocket B
2 balls in pocket C

He learns essentially the following information: The correct solution may include digits 6 and 8, as well as the remaining digits 2, 3 and 5. The other digits 4, 7, 1 and 9 are still possibilities, but less likely than 6, 8, 2, 3 or 5. One of the selected numbers 1 or 9 or 6 or 8 is in the correct row.

Suppose the third guess is "2658", i.e. the player keeps the 6 and 8 in his selection, but he shifts the 6 to the second row (since he knows either the 6 or 8 was in the wrong row). He adds 2 and 5 to his selection. The results of the third guess are:

3 balls in pocket A
1 ball in pocket C

He learns essentially the following information: The 6 and 8 are probably correct digits, and they are probably in the correct rows. Either the 2 or 5 is a correct digit (but not both). Since the "3" digit has not yet been selected it is a more likely candidate than the other already-selected digits 1, 4, 7 or 9.

Suppose the player's next guess is "2638", i.e. he keeps the 2, 6 and 8 from the previous selection (and assumes they are in the correct rows), and adds the 3 to the selection. The results are as follows:

4 balls in pocket A.

This represents the correct solution of the "figure riddle".

From the drawings and description of one embodiment of this invention, we can see that this present invention can provide a "set of figure" solution which is unknown and can have many various combinations by random arrangement of cases 1. Moreover, hints are provided according to the figures guessed by the player. Furthermore, since each hint is quickly, directly and accurately generated by the apparatus (not by other players), this invention not only improves the drawbacks of original figure-guessing games, but also enables an individual to proceed through the game by himself, while eliminating the possibility of termination of the game due to incorrect hints provided; the intelligence of original game is retained.

I claim:

1. A "figure-guessing" game comprised of a plural number of balls, a top plate, several separate case types, a base and a gate, wherein each case type includes plural entrance openings, plural exit openings, and several internal paths permitting the passage of balls from the entrance openings to exit-openings, the passages of balls from selected entrance openings to selected exit openings being different from case type to case type;

all said cases having identical outer appearances, differing only internally in the structure of the ball paths;

said base comprising three isolated ball output regions A, B and C which are labelled differently for distinction and removal of the balls;

said top plate comprising plural holes arranged in plural rows, each row including several holes; the rows and holes being labeled with numeral symbols which can represent many numbers;

said gate comprising a movable plate under the top plate for controlling the opening and closure of all holes in the top plate;

wherein the cases are randomly arrangable on said base; said top plate being positioned on the cases so that the entrance openings in each case will connect the various holes on the top plate with different output regions in the base depending on where the cases are arranged on the base.

2. The game of claim 1 wherein the ball passages in the various cases are different for different types of cases; whereby if there are n entrance openings in each case and the three different ball output regions in the base are respectively labeled as A, B, and C, there will be n+1 types of cases, namely, 1st, 2nd, 3rd, 4th, . . . nth, and an 0 type case, in which there is only one of each type of case except the 0 type case whose quantity is not limited; the first entrance opening of the 1st type case being connected to region A, while the other entrance openings are connected with region B regardless of where the 1st type case is placed on the base; the second entrance opening of the 2nd type case being connected to region B, while the other entrance openings are connected to region B regardless of where the 2nd type case is placed on the base; the third entrance opening of the 3rd type case being connected to region A, while the other entrance openings are connected with region B regardless of where the 3rd type case is placed on the base; the fourth entrance opening of the 4th type case being connected to region A, while the other entrance openings are connected with region B regardless of where the 4th type case is placed on the base; and similarly for the nth entrance opening of nth type case being connected to regions A by analogy, while the other entrance openings are in connection with regions B regardless of where the nth type case is placed on the base; all entrances of the 0 type case being in connection with region C regardless of where the 0 type case is placed on the base.

* * * * *